United States Patent [19]

Wilson et al.

[11] 4,098,321

[45] Jul. 4, 1978

[54] POURING POT FOR POURING MOLTEN METAL AT CONSTANT FLOW RATE

[75] Inventors: Thomas Noell Wilson, Carrollton; James R. McCammon, Marietta, both of Ga.

[73] Assignee: Southwire Company, Carrollton, Ga.

[21] Appl. No.: 590,491

[22] Filed: Jun. 26, 1975

[51] Int. Cl.[2] ..... B22D 11/06

[52] U.S. Cl. ..... 164/434; 164/437

[58] Field of Search ..... 164/87, 88, 276, 277, 164/278, 281, 434, 437; 222/DIG. 1, 590, 591, 607; 266/38, 275, 283

[56] References Cited

U.S. PATENT DOCUMENTS

| | | | |
|---|---|---|---|
| 441,643 | 12/1890 | Close | 164/276 |
| 3,333,746 | 8/1967 | Cope et al. | 222/591 |
| 3,457,985 | 7/1969 | Wilson | 164/281 X |
| 3,623,535 | 11/1971 | Lenaeus et al. | 164/87 |
| 3,773,228 | 11/1973 | Koch et al. | 222/607 |

OTHER PUBLICATIONS

Cole et al., "Level Control System for Molten Metal in the Tundish", Western Electric, Technical Digest No. 9, Jan. 1968.

*Primary Examiner*—Richard B. Lazarus

*Attorney, Agent, or Firm*—Herbert M. Hanegan; Stanley L. Tate; Robert S. Linne

[57] ABSTRACT

A pouring pot for pouring molten metal into a casting mold of a continuous casting apparatus comprises upper and lower pot sections with the upper pot section having a volume sufficiently larger than the effective volume of the lower pot section so as to maintain the molten metal pressure depth and therefore the pressure head substantially constant despite fluctuations in the total amount of molten metal in the pouring pot to thereby effect discharging of the molten metal at a substantially constant flow rate. The upper pot section has a volume at least 20% greater and preferably 20%-40% greater than the effective volume of the lower pot section. The overall volume of the pouring pot is similar to that of conventional low volume pots now in use so that conventional supporting equipment can be used to support the pouring pot.

10 Claims, 3 Drawing Figures

POURING POT FOR POURING MOLTEN METAL AT CONSTANT FLOW RATE

BACKGROUND OF THE INVENTION

The present invention relates generally to continuous casting systems wherein molten metal is continuously cast into metal rod, and more particularly, relates to a pouring pot for pouring molten metal into a continuous casting mold at a substantially constant flow rate.

In the continuous casting of metal rod, molten metal is transferred from a melting furnace or holding furnace to a continuous casting mold formed in a rotary mold ring and the mold ring is rotationally driven to effect continuous casting of the molten metal into cast rod. Since the transfer of molten metal occurs while the mold ring is rotating, it is necessary to accurately control the pouring of the molten metal into the casting mold in order to obtain a satisfactory cast rod product.

Prior to the advent of continuous casting systems, it was common practice in the metal foundry field to pour the molten metal directly from the melting furnace into stationary casting molds and sufficiently accurate control of the pouring could be obtained since such was a batch pouring. However, due to the large and cumbersome construction of the melting furnaces and their difficulty in handling, an intermediate pouring pot was introduced at a location between the melting furnace and the casting molds and the pouring pot functioned as a temporary reservoir for the molten metal and enabled more accurate control of the pouring of the molten metal into the casting molds. Since casting with stationary molds is basically a batch process, sufficiently accurate control of the pouring of molten metal from the intermediate pouring pot into the casting molds can be accomplished using comparatively crude manual and mechanical controls.

In continuous casting systems, however, the molten metal is poured into a moving casting mold and therefore much greater accuracy in control of the pouring of the molten metal into the casting mold is required than in conventional metal foundry practice using stationary casting molds. It has thus become common practice in the continuous casting art to employ an intermediate pouring pot to more accurately control the pouring of the molten metal into the continuous casting mold.

The primary function of the pouring pot is to discharge the molten metal directly into a moving casting mold at a substantially constant flow rate so that the molten metal is uniformly fed to the casting mold. The discharge flow rate of the molten metal from the pouring pot is proportional to the discharge velocity of the molten metal which in turn is a direct function of the molten metal pressure head in the pot. Thus, as the amount of molten metal in the pouring pot varies, the pressure head likewise varies causing fluctuations in the discharge flow rate. The molten metal is customarily fed from the melting furnace to the pouring pot at a nonuniform rate and one function of the pouring pot is to compensate for variations in the feeding rate of molten metal from the melting furnace and discharge the molten metal into the moving casting mold at a substantially constant flow rate.

A major difficulty in maintaining a constant discharge flow rate of molten metal from the pouring pot resides in compensating for fluctuations in the molten metal depth which are caused by different rates of charging and discharging of molten metal into and out of the pouring pot. As any change in depth of the molten metal in the pouring pot results in a proportionate change in discharge flow rate, it is necessary to either minimize depth changes and maintain them within controlled limits or accept such changes in molten metal depth and compensate for them. Much emphasis has been placed on the latter type of control and to this end, it is now common practice to employ a metering device for metering the discharge flow rate and adjust for changes in the molten metal depth. The metering device typically comprises an adjustable metering pin which controls the rate of molten metal flow by increasing or decreasing the outlet opening in the pouring pot. The disadvantage of this type of control is that if it is done manually, it requires the constant attention of a workman and if it is done automatically, it requires additional equipment and controls thereby increasing production and maintenance costs. Moreover, it has not been possible to date to design a completely satisfactory automatic system.

The other type control comprises simply increasing the overall volume of the pouring pot so as to reduce the amount of molten metal depth change for a given change in total volume of molten metal in the pouring pot. However, this technique is disadvantageous in that it requires a much larger and more massive pouring pot which, when filled with molten metal, has considerable weight. Hence, a more massive supporting structure is needed to support such a large volume pouring pot and in the case of an accident, such poses a much greater possibility of danger to workmen in the area then would be the case with smaller volume pouring pots. Moreover, should any problem occur requiring draining of the molten from the pouring pot, a large volume pouring pot is more disadvantageous than a small volume one in that it results in a larger amount of wasted material.

Prior art pouring pots generally have a box-like configuration having at the base region thereof sloped bottom walls. A pouring spout is connected to one of the sloped walls so as to pour the molten metal out of the pouring pot at an angle. The pouring pot has a small molten metal surface area so that a given change in the total amount of molten metal in the pouring pot results in a comparatively large change in the molten metal depth causing a proportionate change in the discharge flow rate of molten metal from the pouring pot. Fluctuations of the molten metal depth cause proportionate fluctuations of the discharge flow rate so that the molten metal is fed unevenly to the casting mold. To compensate for variations in the molten metal depth, it is necessary to employ either an automatic metering device which is relatively sophisticated and expensive or a manual metering device which must be continuously adjusted during use.

SUMMARY OF THE INVENTION

The pouring pot constructed in accordance with the principles of the present invention is designed so that variations of the total amount of molten metal in the pouring pot cause only minimal fluctuations in the molten metal depth so that the molten metal is discharged from the pouring pot at a substantially constant flow rate. The pouring pot is composed of upper and lower pot sections with the upper pot section having a volume sufficiently larger than the effective volume of the lower pot section so as to maintain the molten metal pressure head substantially constant despite fluctuations in the total amount of molten metal in the pouring pot to thereby effect discharging of the molten metal at a substantially constant flow rate. The upper pot section has a volume at least 20% greater and preferably 20%–40% greater than the effective volume of the lower pot section. In other words, the effective volume of the lower pot section is not more than 83.3 percent of the volume of the upper pot section and preferably 71.4 percent to 83.3 percent of the volume of the upper pot section. The overall volume of the pouring pot is similar to that of conventional low volume pots now in use so that conventional supporting equipment can be used to support the pouring pot.

It is therefore a primary object of the present invention to provide a pouring pot which overcomes the drawbacks and disadvantages enumerated above with respect to prior art pouring pots.

Another object of the present invention is to provide a pouring pot for pouring molten metal at a substantially constant flow rate despite fluctuations of the total amount of molten metal contained therein.

A further object of the present invention is to provide a pouring pot configured so as to minimize molten metal depth fluctuation for a given change in total volume of molten metal in the pouring pot thereby maintaining the molten metal pressure head substantially constant to enable pouring of the molten metal at a substantially constant flow rate.

A still further object of the present invention is to provide a pouring pot for discharging molten metal at a substantially constant flow rate despite fluctuations in the volume of molten metal in the pouring pot and with only minimum use of a metering device.

Yet another object of the present invention is to provide, in a continuous casting system, a pouring pot for pouring molten metal at a substantially constant flow rate into a moving continuous casting mold.

Having in mind the above and other objects, features and advantages of the invention that will be evident from an understanding of this disclosure, the present invention comprises a pouring pot and continuous casting system utilizing such a pouring pot as illustrated in the presently preferred embodiment of the invention which is hereinafter set forth in sufficient detail to enable those persons skilled in the art to clearly understand the function, operation and advantages of it when read in conjunction with the accompanying drawings.

DESCRIPTION OF THE PREFERRED EMBODIMENT

Figure 1:
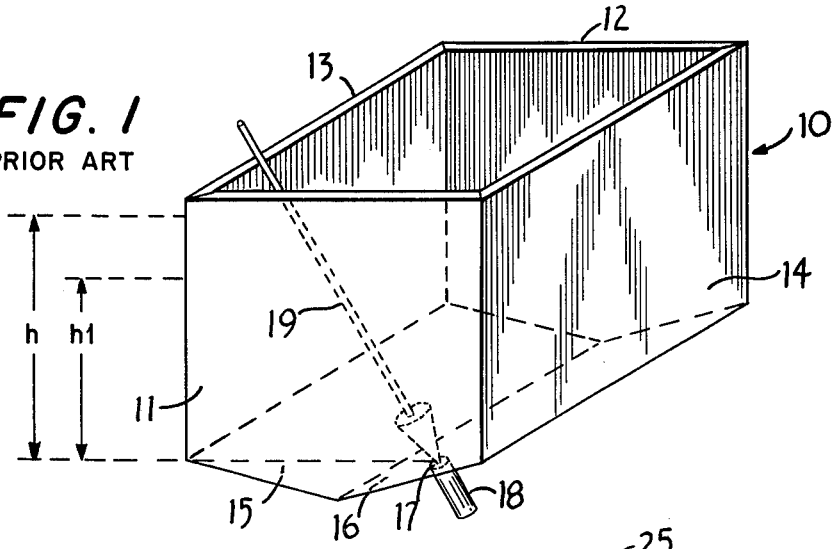
FIG. 1 PRIOR ART
FIG. 1 is a perspective view of a typical prior art pouring pot.

Before delineating the pouring pot of the invention, a brief description of a typical prior art pouring pot and its principles of operation will be given with reference to FIG. 1. The pouring pot 10 has a generally box-like configuration composed of end walls 11 and 12 connected to side walls 13 and 14. The bottom wall of the box-like structure 10 comprises a pair of converging bottom wall portions 15 and 16 which are connected to the bottom edges of the side and end walls. The bottom wall portion 16 is provided with an outlet opening 17 to which is connected a pouring spout 18 for facilitating pouring of the molten metal. The box-like structure 10 has a generally square shape as shown in the drawing. A metering device 19 is connected in a known manner to control the size of the outlet opening 17.

During use of the pouring pot 10, molten metal is charged therein from a melting furnace and for purposes of explanation, it will be assumed that the molten metal is filled to a depth $h$ with respect to the outlet opening 17 and this corresponds to a static pressure head $h$ due to the depth of the molten metal. The flow rate of the molten metal through the outlet opening 17 is dependent upon the cross-sectional area of the outlet opening 17 and the velocity of molten metal flow, and when the outlet opening area is constant, flow rate varies solely as a function of velocity or pressure head variations.

The velocity of molten metal through the outlet opening 17 varies as a function of the pressure head $h$ and is represented by the following relationship:

$$v = \sqrt{2ghk}$$

where $v$ = discharge velocity of molten metal $g$ = gravitational constant $h$ = static pressure head $k$ = a constant whose value depends on the type of metal, the metering device and the pouring spout configuration Thus, it can be readily seen that fluctuations in the static pressure head or molten metal depth $h$ cause proportionate changes in the discharge velocity and hence changes in the discharge flow rate. For the pouring pot 10 shown in FIG. 1, a change in total volume of molten metal in the pouring pot by an amount $\Delta V$ causes a reduction in the molten metal depth from $h$ to $h1$ thereby causing a proportionate decrease in the discharge flow rate. Hence, it can be seen that minor fluctuations in the total amount of molten metal in the pouring pot 10 result in corresponding variations in the discharge flow rate which causes uneven pouring of the molten metal into the casting mold.

The pouring pot 20 constructed in accordance with the present invention will now be described with reference to FIG. 2. The pouring pot 20 comprises an upper pot section 21 integrally connected and forming a unitary structure with a lower pot section 22. The upper pot section 21 comprises two upper end walls 24 and 25 which are interconnected to upper side walls 26 and 27 to form a box-like structure. The upper portion of the box-like structure is open and defines an inlet opening for receiving molten metal from a melting furnace during use of the pouring pot. A pair of bottom wall projections 28 and 29 are connected to the bases of side walls 26 and 27, respectively, and extend along their entire lengths. The bottom wall projections project inwardly towards one another and are sloped slightly downwardly to ensure smooth downward flow of the molten metal.

The lower pot section 22 comprises two lower end walls 30 and 31 which are connected to the upper end walls 24 and 25, respectively. The lower end walls 30 and 31 are preferably formed as one-piece, unitary structures with the upper end walls 24 and 25. Lower side walls 34 and 35 are connected to the lower end walls 30 and 31 and are also connected to respective ones of the bottom wall projections 28 and 29 of the upper pot section in the manner shown. The lower side walls converge inwardly and downwardly towards one another and are joined at their base by a bottom wall 37. In the embodiment shown, each converging lower side wall 34 and 35 is comprised of two rectangular segments the lower of which converges at a steeper angle than the upper one. An outlet opening 38 is provided in the lower side wall 35 through which the molten metal discharges from the pouring pot. A pouring spout 39 is connected to the lower side wall 35 overlying and in communication with the outlet opening 38 for aiding in the discharge and pouring of molten metal into the casting mold. It will be apparent that both the upper and the lower pot sections have an average horizontal cross-sectional area which is readily mathematically determinable given the linear dimensions of the pouring pot. Hereinafter, reference to cross-sectional areas of the pouring pot sections is intended to refer to the average horizontal cross-sectional area. It will also be apparent that the average cross-sectional area as well as the effective volume of the lower pot section are determined with reference to the lowest point of the outlet opening 38 inasmuch as the cross-sectional area, volume and metal depth below this point do not affect the flow rate from the pour pot. Thus, any reference to the parameters herein is based on the magnitude of such parameters as determined from a horizontal plane though the outlet opening 38.

In accordance with one aspect of the present invention, it has been found that by forming the upper pot section 21 with a volume at least 20% greater than and preferably 20%–40% greater than the effective volume of the lower pot section 22, it is possible to successfully minimize variations of the discharge flow rate of molten metal during pouring which may otherwise occur. More particularly, according to the invention, the differences in volume are achieved by corresponding differences in the average horizontal cross-sectional areas of the upper pot section and the effective lower pot section so that the upper pot section 21 has an average cross-sectional area at least 20%–40% greater than that of the effective lower pot section. Such a construction ensures that variations of the total quantity of molten metal in the pouring pot cause only slight depth variations due to the relatively large average horizontal cross-sectional area of the upper pot section. Due to the fact that the effective volume of the pouring pot is a direct function of the product of the average cross-sectional area and effective depth parameters, and since the upper pot section 21 has a relatively large average cross-sectional area, normal changes in the amount of molten metal which occur during use of the pot are accompanied by only small changes in the overall effective metal depth thereby maintaining the pressure head substantially constant. For purposes of explanation and assuming that the pouring pot 20 has the same volume and holds the same amount of molten metal as the prior art pouring pot 10 shown in FIG. 1, the example given with respect to FIG. 1 will now be continued with respect to FIG. 2. When the pouring pot 20 is full of molten metal, the molten metal has a depth *h* thereby producing a static pressure head *h* at the level of the outlet opening 38. Thus, like the prior art pouring pot, the discharge flow rate of molten metal through the outlet opening and out the pouring spout 39 will be proportional to the pressure head *h*.

Figure 2:
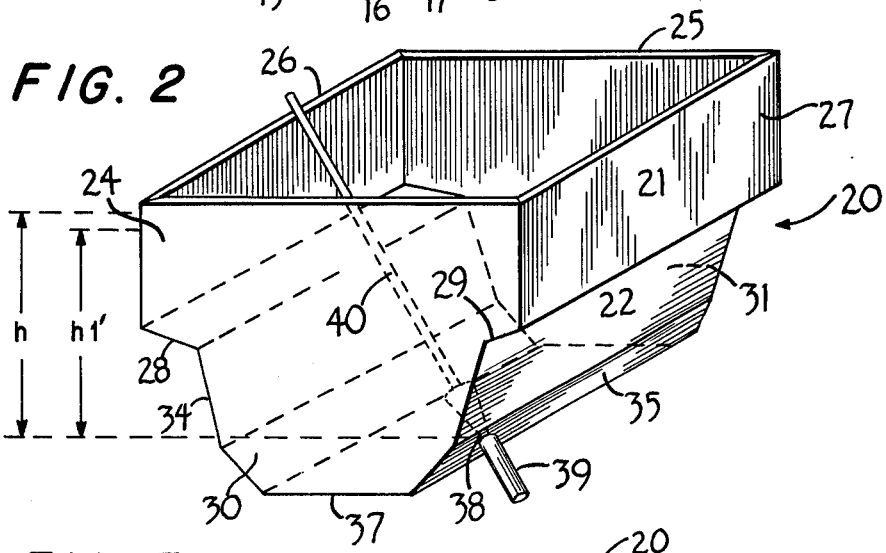
FIG. 2 is a perspective view of a pouring pot constructed in accordance with the principles of the present invention.

However, due to the novel configuration of the pouring pot 20 and more particularly, due to the fact that the upper pot section 21 has a volume at least 20% greater than the effective volume of the effective lower pot section 22, a change in volume of molten metal in the pouring pot 20 by an amount $\Delta V$ results in a much lesser reduction in depth of the molten metal than in the case of the prior art pouring pot 10 and as diagrammatically shown in FIG. 2, the resulting pressure head $h1'$ is greater than the corresponding pressure head $h1$ of the prior art pouring pot for the same change in total volume of molten metal.

Thus, it can be appreciated that for a given change $\Delta V$ in total volume of molten metal in the pouring pot, the pressure head *h* varies only slightly due to the novel configuration of the pouring pot 20 thereby maintaining the discharge flow rate of molten metal at a substantially constant value. The pouring pot 20 is designed to maintain a much larger volume of molten metal in the upper section of the pot than in the effective lower section so that changes in total volume of molten metal cause minimal changes in molten metal depth and in this manner, the discharge flow rate of the molten metal is maintained substantially constant despite fluctuations in the total molten metal volume.

Figure 3:
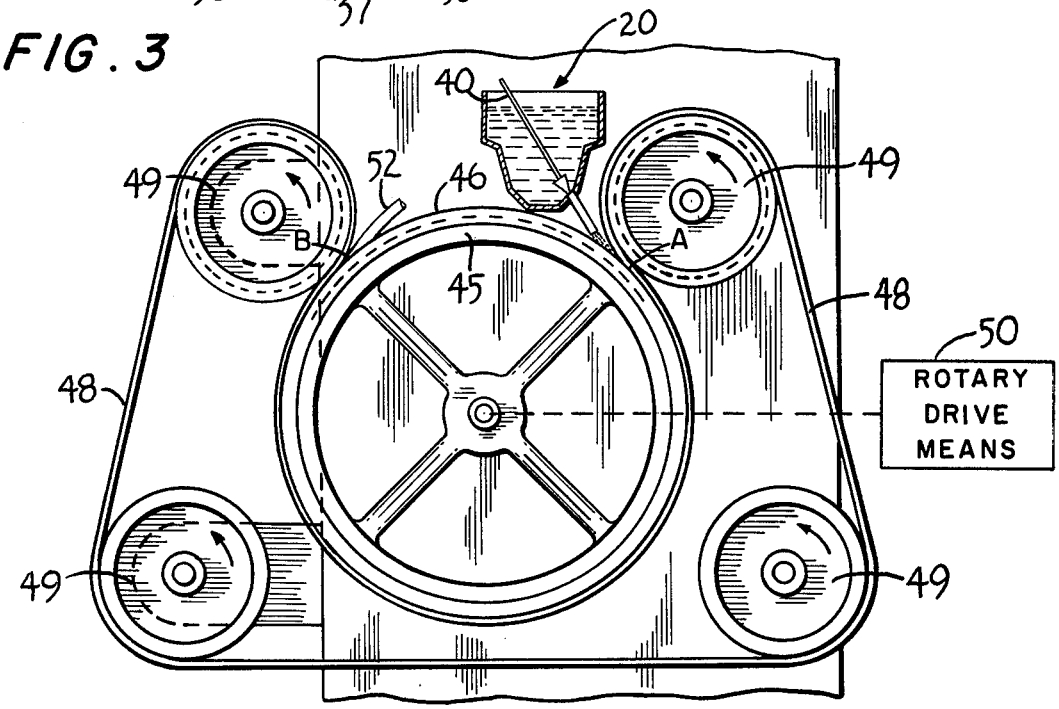
FIG. 3 is a side elevational view, partly in section, of a portion of a continuous casting system utilizing the pouring pot of the present invention.

The pouring pot 20 according to the invention is shown in FIG. 3 in its actual working environment in conjunction with a continuous casting apparatus. The continuous casting apparatus has been shown only in schematic form and only with those features needed to understand the present invention. In its actual operational state, the continuous casting apparatus includes numerous other componenets which have been omitted here for sake of clarity and ease of explanation.

The continuous casting apparatus comprises a rotary mold ring 45 rotatably mounted on a frame assembly and a peripheral groove 46 extends around the periphery of the mold ring. An endless flexible metal band 48 encircles both a portion of the mold ring 45 as well as a portion of a set of band-positioning rollers 49 such that a continuous casting mold is defined by the groove 46 in the mold ring and the overlying metal band 48 between the points A and B. Rotary drive means 50 is mechanically connected to the mold ring 45 for rotationally driving the same. The pouring pot 20 is positioned at an elevation above the mold ring 45 and maintained there by suitable support structure (not shown) such that the pouring spout 39 leads into the entrance opening of the casting mold at the point A.

In operation, molten metal is fed to the pouring pot 20 from a melting furnace (not shown) and the molten metal is poured from the pot 20 through the discharge spout 39 into the continuous casting mold. The rotary drive means 50 rotationally drives the mold ring 45 so as to transport the metal to the exit point B. A cooling system and other equipment not shown aid in solidifying and partially cooling the metal during its transport between the points A and B so that when the metal reaches the point B, it is in the form of a solid cast rod 52.

Since the casting apparatus operates in a continous mode, it is necessary to charge the molten metal into the continuous casting mold at a substantially constant flow rate so as to enable formation of a uniform cast bar product. This is effectively carried out by the pouring pot 20 of the invention which maintains a substantially constant discharge flow rate of molten metal into the mold ring despite fluctuations in the total volume of molten metal contained in the pouring pot caused by uneven or nonuniform feeding of the molten metal into the pot from the melting furnace.

Thus, it may be seen that the pouring pot of the present invention effectively eliminates fluctuations in the discharge flow rate of the molten metal without the necessity of continuously adjusting a metering device. Of course, a metering device can be used in conjunction with the pouring pot 20 so as to obtain an even more fine control of the discharge flow rate or to adjust the opening to the pouring spout to selectively change the overall production rate and such a metering device 40 is shown in FIGS. 2 and 3. The metering device 40 is of well known construction, similar to the one shown in FIG. 1, and need not be further described for purposes of understanding the present invention.

While the invention has been disclosed with reference to one preferred embodiment, it is understood that many modifications thereof and changegs thereto will become apparent to those ordinarily skilled in the art and the present invention is intended to cover all such obvious modifications and changes which fall within the spirit and scope of the invention as defined in the appended claims.

I claim:

1. In combination with a continuous casting machine including means for feeding molten metal to a pouring pot means having a molten metal discharge outlet and means for shaping the molten metal discharged from said outlet, said pouring pot means being of a given volume and adapted to contain the molten metal up to a given head, said pouring pot means comprising an upper section and a lower section, means defining an inlet opening into said upper section for receiving a substantially continuous supply of molten metal, said discharge outlet being located in a lower portion of said lower section;

the improvement wherein said upper section is delimited by an uppermost free edge, opposed end walls and opposed vertical side walls extending downwardly from said free edge, said lower section being delimited by a bottom wall, opposed end walls and opposed downwardly converging side walls, said lower section end walls and converging side walls extending downwardly from the lower ends of the upper section end walls and vertical side walls, respectively, said lower section including an effective lower section delimited by said lower section end walls, converging side walls and a horizontal plane through the discharge outlet, said effective lower section having an effective volume and an effective average cross-sectional area, the average cross-sectional area of the upper section being greater than the effective average cross-sectional area of the effective lower section and the volume of the upper section being 20% to 40% greater than the effective volume of the effective lower section, whereby the rate of change of the head resulting from changes in the unit volume rate of flow of metal out of the pouring pot means is decreased as compared with prior art pouring pots having the same volume and head.

2. The improvement according to claim 1, including a discharge spout connected to said lower section in overlying, flow communicating relation with said outlet for aiding in the discharge and pouring of molten metal from said pouring pot means into said shaping means.

3. The improvement according to claim 1, including metering means coacting with said outlet for selectively adjusting the size of said outlet to effect metering of the flow rate of molten metal from said pouring pot means.

4. The improvement according to claim 1, wherein the end walls of the upper and lower sections are vertical and coplanar.

5. The improvement according to claim 4, wherein said means defining an inlet opening is said uppermost free edge.

6. In combination with a continuous casting machine including means for feeding molten metal to a pouring pot means having a molten metal discharge outlet and means for shaping the molten metal discharged from said outlet, said pouring pot means being of a given volume and adapted to contain the molten metal up to a given head, said pouring pot means comprising an upper section and a lower section, means defining an inlet opening into said upper section for receiving a substantially continuous supply of molten metal, said discharge outlet being located in a lower portion of said lower section;

the improvement wherein said upper section is delimited by an uppermost free edge, opposed end walls and opposed vertical side walls extending downwardly from said free edge, said lower section being delimited by a bottom wall, opposed end walls and opposed downwardly converging side walls, said lower section end walls and converging side walls extending downwardly from the lower ends of the upper section end walls and vertical side walls, respectively, said lower section including an effective lower section delimited by said lower section end walls, converging side walls and a horizontal plane through the discharge outlet, said effective lower section having an effective volume and an effective average cross-sectional area, the volume of said upper section being greater than the effective volume of the effective lower section and the average cross-sectional area of the upper section being 20% to 40% greater than the effective average cross-sectional area of the effective lower section whereby variations in the level of head of molten metal occurring as a result of changes in the volume rate of metal flowing through said outlet are minimized.

7. The improvement according to claim 6, including a discharge spout connected to said lower section in overlying, flow communicating relation with said outlet for aiding in the discharge and pouring of molten metal from said pouring pot means into said shaping means.

8. The improvement according to claim 6, including metering means coacting with said outlet for selectively adjusting the size of said outlet to effect metering of the flow rate of molten metal from said pouring pot means.

9. The improvement according to claim 6, wherein the end walls of the upper and lower sections are vertical and coplanar.

10. The improvement according to claim 6, wherein said means defining an inlet opening is said uppermost free edge.

* * * * *